United States Patent [19]

Gardiner

[11] 3,987,960

[45] Oct. 26, 1976

[54] SHIPPING FORMS AND ENVELOPE

[75] Inventor: Alec R. Gardiner, Brampton, Canada

[73] Assignee: Metro Toronto News Company Limited, Scarborough, Canada

[22] Filed: Nov. 26, 1975

[21] Appl. No.: 635,611

[52] U.S. Cl. ..... 229/74; 282/25; 283/21

[51] Int. Cl.[2] ..... B65D 27/00; G09F 3/10

[58] Field of Search ..... 229/74; 282/25; 283/18, 283/21; 40/312

[56] References Cited

UNITED STATES PATENTS

| | | | |
|---|---|---|---|
| 1,203,902 | 11/1916 | Nichols | 283/18 |
| 2,302,992 | 11/1942 | Gardner | 229/74 |
| 3,525,470 | 8/1970 | Carrigan | 229/74 |
| 3,580,489 | 5/1971 | Oettinger | 229/74 X |

FOREIGN PATENTS OR APPLICATIONS

| | | | |
|---|---|---|---|
| 659,556 | 3/1963 | Canada | 282/25 |

*Primary Examiner*—Stephen P. Garbe
*Attorney, Agent, or Firm*—Sim & McBurney

[57] ABSTRACT

This invention provides a shipping form for parcel items. The form includes a label to be adhered to the parcel item, composed of two superposed layers joined at three edges to form an envelope. One of the layers has glue or the like for adhesion to the parcel item, while the other layer is marked to display the destination, etc. A number of additional sheets are provided over the layer bearing the destination, with copy-producing layers between each adjacent layer. At least one of the sheets is intended to accompany the parcel item. The sheets and the label may be severed from one another, and the sheet intended to accompany the parcel item can be folded and inserted in the envelope defined by the two layers.

9 Claims, 4 Drawing Figures

SHIPPING FORMS AND ENVELOPE

This invention relates generally to shipping forms, and has to do particularly with the kind of multi-sheet shipping form which is typically used in connection with parcels, packages, and other shipped items.

BACKGROUND OF THIS INVENTION

One conventional arrangement of a shipping form includes a plurality of sheets superposed and connected together at marginal portions, together with a label, usually of stiffer paper, also connected to the other sheets at a marginal portion. All sheets and the label may be detached along lines of perforations. The sheets may typically include a shipper's receipt, an accounting copy, a delivery receipt, a consignee's copy and the driver's copy. Carbon paper or some copy-producing layer is interposed between each adjacent pair of sheets. Some of the sheets are usually removed at the point of shipping, for use at that location. At least one sheet, however, normally accompanies the package or parcel item, and may be left connected to the label, which latter is then adhered to the package by means of an adhesive on its back side, typically covered by a greased paper layer which is intended to be removed prior to adhesion. The difficulty with this prior art procedure is that if one or more sheets are left attached to the label, they will tend to flap around loose, get scraped or rubbed off, damaged, torn, and so forth during the shipping of the package, which often involves rough handling, jostling against other packages, and similar treatment. Because of this risk, the sheet or sheets intended to accompany the parcel item are often removed from the label, and stuck away in a glove compartment, pocket, wallet or similar location until the destination is reached. This procedure not only is awkward and time-consuming, but also entails the risk that the sheets thus stashed away may become lost or damaged in transit.

In view of the foregoing disadvantage of the conventional arrangement, it is an aspect of this invention to provide an improved shipping form which allows the sheet or sheets intended to accompany the package to do so with considerably reduced likelihood of damage, loss, or disfigurement.

GENERAL DESCRIPTION OF THIS INVENTION

Accordingly, this invention provides a shipping form for a parcel item, comprising: a label intended to be adhered to the parcel item, the label including two superposed layers joined at three edges to form an envelope enclosure, one of said layers having adhesion means on its outer face, the other layer being adapted to display the destination of the parcel item, a plurality of sheets superposed over said other layer with a copy-producing layer between each pair of adjacent sheets and between the label and the next adjacent sheet, at least one of said sheets being intended to accompany the parcel item, and severable means retaining the sheets and the label in superposed relation, whereby the sheet intended to accompany the parcel item may be severed from said severable means, and inserted in the envelope enclosure defined by the label.

GENERAL DESCRIPTION OF THE DRAWINGS

Two embodiments of this invention are illustrated in the accompanying drawings in which like numerals denote like parts throughout the several views, and in which.

DETAILED DESCRIPTION OF THE DRAWINGS

Figure 1:
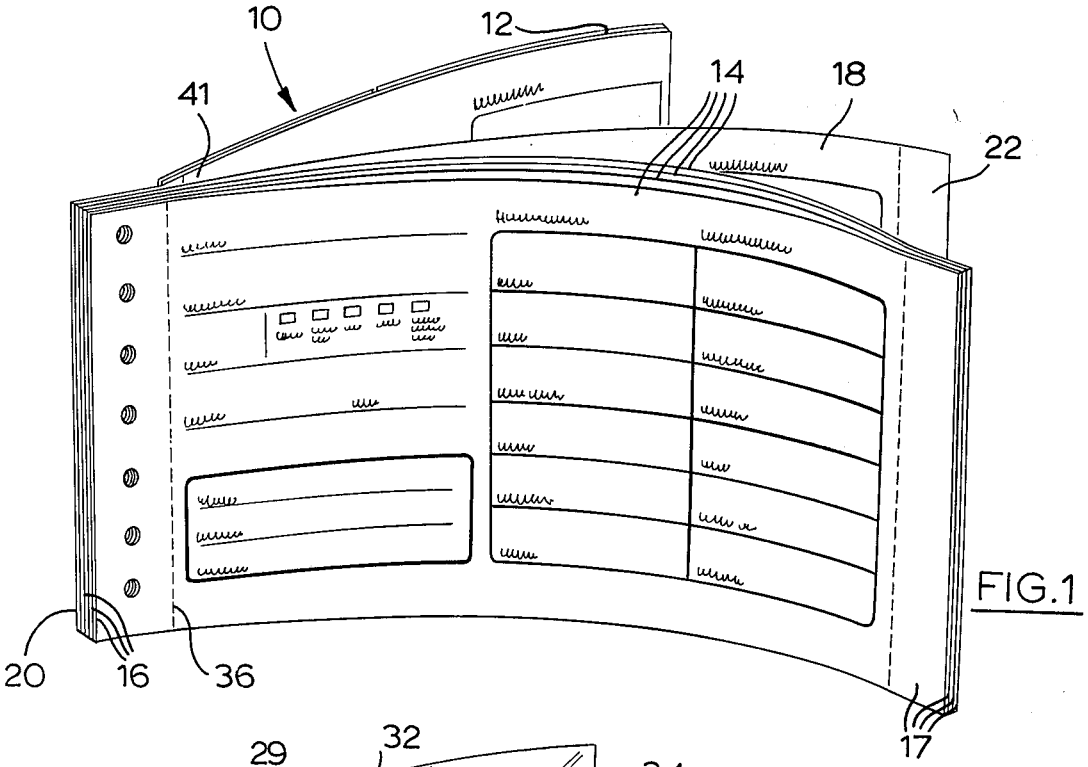
FIG. 1 is a perspective view of a shipping form according to the first embodiment of this invention.

Attention is first directed to FIG. 1 which illustrates a shipping form 10, which includes a label 12 which is intended to be adhered to a parcel item, a plurality of sheets 14 adhered to each other at either end along first marginal portions 16 and second marginal portions 17, and a further sheet 18 adhered to the other sheets 14 at its leftward marginal portion 20. The rightward marginal portion 22 of the sheet 18 is shown to be unconnected, although the decision whether to adhere the marginal portion 22 of the sheet 18 to the other marginal portions 17 is a matter of choice.

The uppermost sheet 14 (that closest to the viewer in FIG. 1) can be seen to bear on its face suitable blocks, lines and other indicia for the entering of the required information regarding the consignee, the shipper's name, contents of the parcel item, the appropriate addresses, costs, weight, value, and the like. It is to be understood that all of the sheets 14 and 18 are similarly or identically marked, and that there is provided some form of copy-producing layer between each pair of adjacent sheets 14, 18, as well as between sheet 18 and the label 12. The copy-producing layers may be individual sheets of carbon paper attached at one or both marginal regions between the marginal portions of the sheets, or alternatively may include a layer of carbon or like material applied directly to the rear surface of each of the sheets 14, 18.

It is seen in FIG. 1 that the label 12 is somewhat shorter than the sheets 14, 18. This is not essential to the invention, but it is typical of shipping forms, due to the fact that the label need not display all of the information that is entered on the sheets.

The label includes two superposed layers or sheet members 24 and 26, these layers being joined at three edges 27, 28 and 29 by gluing or the like to define an envelope enclosure to which access may be had at the remaining edge 30. Preferably, the layer 26 is of card material or at least stiffer paper than the layer 24, and has on its rear face (the face away from the viewer in the figures) a layer of adhesive of the permanently self-sticking variety, this layer being protected by waxed or greased masking sheets 32 which are shown in FIG. 1 to be juxtaposed against the layer 26, and in FIG. 2 to be removed and slightly separated from the layer 26. The self-sticking adhesive is seen on the turned over corner in FIG. 2, identified by the numeral 34.

It is assumed that the markings and indicia on the sheets 14, 18 and the label 12 are such that it is intended that only the sheet 18 accompany the parcel item being shipped. Naturally, any alternative arrangement utilizing more than one sheet shipped with the parcel could also be employed, as will readily appear from what follows.

In use, the shipper impresses the necessary information on the outermost or "closest" sheet 14 as seen in FIG. 1, thus transferring the same information to the other sheets 14, 18 and to the label 12 by virtue of the carbon layers interposed therebetween. The sheets 14 are then torn away from their marginal portions 16 by virtue of lines 36 of perforations defining the marginal portions 16, and are utilized in the normal fashion at the point of shipping. These sheets may include a shipper's receipt, an accounting copy, a billing abstract and a driver's copy. The sheet 18, however, may constitute a delivery receipt which must accompany the parcel item. The sheet 18 is removed from the label in a similar manner, by tearing along a line of perforations aligned with the lines 36, and then the sheet 18 is folded down to a size small enough to permit it to be slipped into the envelope enclosure defined between the two layers 24 and 26 of the label 12, this being illustrated by the arrows in FIG. 2. Thus enclosed and protected, there is no danger of either loss or damage to the sheet 18 during the shipping process.

The attachment of the label 12 initially to the sheets 14, 18 is preferably accomplished through the layer 24, which initially has a leftwardly extending marginal portion which is adhered or otherwise attached to the marginal portions 16, 20. A line 41 of perforations constitutes a location at which the label 12 may be severed from the sheets, and in FIG. 2 it will be seen that the leftward edge 42 of the layer 24 shows evidence of having been torn along a perforation. Also it will be seen in FIG. 2 that the leftward edge 42 of the layer 24 is spaced inwardly from the corresponding edge 43 of the layer 26. The purpose of this inward spacing is firstly to allow easy access to the envelope enclosure defined between the two layers 24 and 26, and secondly to protect the edge 42 from tearing or fraying during the shipping process.

Figure 2:
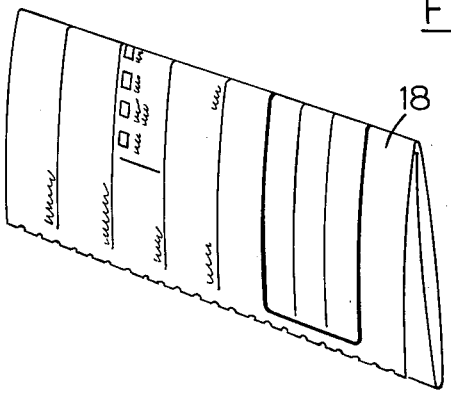
FIG. 2 is a perspective view of the label portion of the shipping form of FIG. 1, and one of the sheets originally adhered thereto, illustrating the use of the shipping form.

Thus, the label is removed from the marginal portions 16, 20 by tearing along the line 41, the folded-up sheet 18 is inserted between the layers 24 and 26 as shown in FIG. 2, the waxed or greased masking sheets 32 are removed, and the label (containing sheet 18) is adhered to the parcel item.

Figure 3:
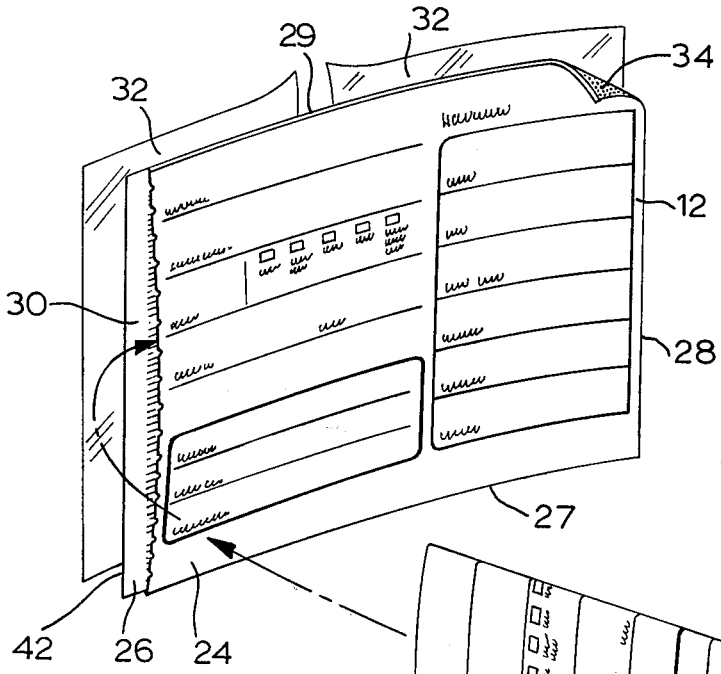
FIGS. 3 and 4 are partial views of the label portion of the shipping form according to the second embodiment of this invention.
Figure 3:
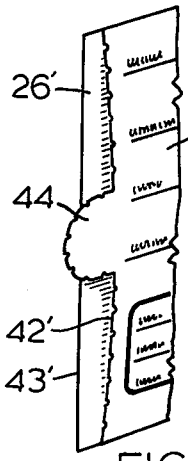
Figure 4:
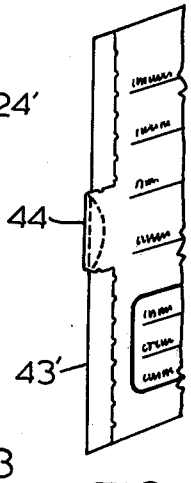

Attention is now directed to FIGS. 3 and 4, which illustrate a portion of the second embodiment of this invention. The second embodiment differs fromt the first only in that the edge 42' of the layer 24' defines a projecting tab 44 which extends beyond the leftward edge 43' of the layer 26'. To provide for the projecting tab 44, the line of perforations (indicated at 41 in FIG. 1 for the first embodiment) would be suitably shaped so that when the label is severed from the other sheets, the tab 44 would be left.

In use, the label is severed as just described, and the sheet 18 intended to accompany the parcel item is folded as seen in FIG. 2 and then inserted between the layers 24' and 26', just as in the first embodiment. The waxed or greased masking sheets 32 are then removed, the projecting tab 44 is folded around and under the edge 43' as seen in FIG. 4, and the label is then adhered to the parcel item. This procedure will entrap the tab 44 between the parcel item and the layer 26', and moreover the adhesive on the back of the layer 26' will ensure that the tab 44, once folded over, will remain in place. The second embodiment thus is one in which accidental dislodgement of the contained sheet 18 is extremely unlikely.

In the appended claims, the expression "copy-producing layer" is intended to include both individual sheets of carbon paper between the sheets 14, 18 and between the sheet 18 and the label 12, and the provision of a simple coating or layer of carbon or like copying material directly on the back or rear surface of each of the sheets 14, 18. It will be appreciated that the copy-producing layer between the sheet 18 and the label 12 need only be the length of the label 12.

Also in the appended claims, the expression "severable means" is intended to include any means which provisionally attach the different components of the shipping form together, so long as the means is capable of allowing separation of the different components. The joining together of the rightward marginal portions 17 as shown in FIG. 1 is not essential to the invention, and may be omitted. The primary reason for including the attachment at either end of the sheets 14 is to minimize the likelihood of ripping or creasing the sheets.

I claim:

1. A shipping form for a parcel item, comprising:

a label intended to be adhered to the parcel item, the label including two superposed layers joined at three edges to form an envelope enclosure, one of said layers having adhesion means on its outer face, the other layer being adapted to display the destination of the parcel item, a plurality of sheets superposed over said other layer with a copy-producing layer between each pair of adjacent sheets and between the label and the next adjacent sheet, at least one of said sheets being intended to accompany the parcel item, and severable means retaining the sheets and the label in superposed relation, the label being connected to the sheets through said other of said layers, the latter having a marginal portion which is defined by a line of perforations, said marginal portion being attached to similar marginal portions of said sheets, likewise defined by lines of perforations, whereby all marginal portions may be removed from their respective label or sheets by tearing, the marginal portions and lines of perforations constituting said severable means;

whereby the sheet intended to accompany the parcel item may be severed at its line of perforations and inserted in the envelope enclosure defined by the label.

2. The invention claimed in claim 1, in which said adhesion means is a self-adhering gummed layer, initially protected by a greased masking layer which is removable prior to adhering the label to the parcel item.

3. The invention claimed in claim 1, in which said first-mentioned line of perforations is spaced inwardly from the corresponding edge of said one of said layers.

4. The invention claimed in claim 1, in which said copy-producing layers are carbon sheets.

5. The invention claimed in claim 1, in which said copy-producing layers are carbon layers on the backs of all said sheets.

6. The invention claimed in claim 3, in which the ends of the sheets opposite said marginal portions are attached together along opposite marginal portions, said opposite marginal portions being likewise defined by further lines of perforations in said sheets.

7. The invention claimed in claim 1, in which said other layer of said label has a projecting tab extending beyond the corresponding edge of said one of said layers, whereby after insertion of said sheet into said envelope enclosure the projecting tab may be folded around and under the edge of said one of said layers, to provide positive retention of said sheet in the envelope enclosure.

8. The invention claimed in claim 3, in which said other layer of said label has a projecting tab extending beyond the corresponding edge of said one of said layers, whereby after insertion of said sheet into said envelope enclosure the projecting tab may be folded around and under the edge of said one of said layers, to provide positive retention of said sheet in the envelope enclosure.

9. The invention claimed in claim 8, in which the ends of the sheets opposite said marginal portions are attached together along opposite marginal portions, said opposite marginal portions being likewise defined by further lines of perforations in said sheets.

* * * * *